US007284661B1

(12) United States Patent
Evans et al.

(10) Patent No.: US 7,284,661 B1
(45) Date of Patent: Oct. 23, 2007

(54) BLISTER OPENERS

(75) Inventors: Christopher T. Evans, Long Valley, NJ (US); Christopher Gieda, Long Valley, NJ (US)

(73) Assignee: Union Street Brand Packaging, Flanders, NJ (US)

( * ) Notice: Subject to any disclaimer, the term of this patent is extended or adjusted under 35 U.S.C. 154(b) by 419 days.

(21) Appl. No.: 10/796,121

(22) Filed: Mar. 10, 2004

Related U.S. Application Data

(60) Provisional application No. 60/452,964, filed on Mar. 10, 2003.

(51) Int. Cl.
*B65D 83/04* (2006.01)

(52) U.S. Cl. ..... 206/532; 206/534

(58) Field of Classification Search ..... 206/528, 206/530, 531, 532, 534, 538, 539, 469, 470; 221/25

See application file for complete search history.

(56) References Cited

U.S. PATENT DOCUMENTS 4,074,806 A * 2/1978 Ardito ..... 206/531
4,294,361 A 10/1981 Margulies et al.
4,485,915 A 12/1984 Berghahn
4,537,312 A * 8/1985 Intini ..... 206/531
4,905,866 A 3/1990 Bartell et al.
5,019,125 A 5/1991 Rebne et al.
5,033,616 A 7/1991 Wyser
5,046,618 A 9/1991 Wood
5,109,984 A 5/1992 Romick
5,323,907 A 6/1994 Kalvelage
5,348,158 A 9/1994 Honan et al.
5,437,371 A 8/1995 Lataix
5,472,115 A 12/1995 Whiton
5,489,025 A 2/1996 Romick
5,613,609 A 3/1997 Hamilton et al.
5,673,793 A 10/1997 Seidler
5,722,563 A 3/1998 Hunts
5,758,774 A 6/1998 Leblong
5,816,404 A 10/1998 Seidler
5,862,915 A 1/1999 Plezia et al.
5,878,887 A 3/1999 Parker et al.
5,894,930 A 4/1999 Faughey et al.
5,988,429 A 11/1999 Coe
6,138,830 A 10/2000 Muggli
6,155,454 A * 12/2000 George et al. ..... 221/25
6,161,699 A 12/2000 Gartland
6,206,233 B1 3/2001 Schulze
6,338,407 B2 1/2002 Danville
6,338,408 B1 1/2002 Anderson (Continued)

*Primary Examiner*—Luan K Bui
(74) *Attorney, Agent, or Firm*—James Creighton Wray; Clifford D. Hyra

(57) ABSTRACT

The present invention is a system for opening blister packages. Generally, a cover attachment is fixed to a blister card. Buttons or tabs on the cover attachment are aligned with individual blisters on the blister card and have piercing edges or attachments. A user presses the buttons or lifts tabs and a cover layer over the blisters is pierced. The buttons or tabs are then moved or raised to allow the user to access the contents of the blister by conventional means. Embodiments include hinged tabs, slideable attachments, clamshell-like covers with moveable carriages, rotatable arms with piercing attachments, locking tab mechanisms, and flexible tethered tool devices. A variety of different blister configurations can be used. Additionally, the blister card attachments render the blister card/pack child resistant despite being easier to open.

5 Claims, 14 Drawing Sheets

U.S. PATENT DOCUMENTS 6,345,717 B1 2/2002 Flewitt
6,416,857 B1 7/2002 Wright et al.
6,726,053 B1 * 4/2004 Harrold ..... 221/25
6,854,618 B2 * 2/2005 Harrold ..... 221/25

* cited by examiner

BLISTER OPENERS

This application claims the benefit of U.S. Provisional Application No. 60/452,964, filed Mar. 10, 2003.

BACKGROUND OF THE INVENTION

Blister packaging is commonly used for pharmaceuticals and other products. Pills or other small products are deposited in individual blisters on sheets of material. Each sheet of blisters has a variable number and arrangement of blisters, but each sheet generally has blisters formed in rows or other geometric patterns. After the pills or other products are deposited in the blisters, a sheet of covering material is applied over the entirety of the blister package and the cover material is sealed to the blister card. The cover material is generally a foil covered lid stock. The cover material seals the pills or other products into the blister and prevents air from interacting with them.

In order to open the blister package, a user must break the cover material seal. The user must push the product through the cover material or break the cover material and peel it off of the blister. Because many pharmaceuticals are packaged in blister packaging, the packages are often child resistant to prevent children from harming themselves by taking medication that is not theirs or that is toxic.

Current child safe blister packaging inherently is generally known to be difficult to open. Child resistant lidding, such as reinforced foil stock, paper, or plastic laminate, is difficult for the average adult to open. It is especially difficult for seniors with declining manual dexterity and those who are physically impaired to access many important medications. Current child safe blister packages cause much frustration because of the difficulty of opening individual blisters.

Needs exist for improved methods of opening childproof packaging to allow for easier access to pharmaceuticals and other products in blister type packaging.

SUMMARY OF THE INVENTION

The present invention addresses the difficulties of opening blister type childproof packaging. The present invention includes embodiments that offer dual child resistance and the ability to use non-CR foil lid-stock. Additionally, the ability to provide printed cues and counting devices on the proposed inventions aids in patient compliance. This may include patients more closely adhering to a proper dosage regimen as outlined by drug manufacturer or distributor.

An embodiment of the present invention is a product ejection system for blister packages. A cover attachment is fixed to a blister card with snaps or heat stake posts. Tabs are pressed down by the user and cut a cover layer. The cover layer is completely cut and the contents of individual blisters can be removed.

Another embodiment is a bend and lift system for opening blister packages. A tongue is attached to the periphery of a blister card attachment. The user bending the blister card lifts the tongue initially, when the tongue is raised far enough, the user grasps it and pulls up. This gives the user access to the cover layer underneath and the pill can be removed by conventional means.

Another embodiment is a bubble piercing slide attachment system for opening blister packages. An attachment folds around a blister package and slides up and down the blister card. When positioned over a blister, a button can be depressed that pierces a cover layer. The attachment is then slid away and the user can remove the contents of the blister.

Another embodiment is a traversing button with push thru tabs system for opening blister packages. An attachment wraps around a blister card in a clamshell-like manner. A carriage attached to a frame is moveable to any position on the blister card. A button is positioned on the carriage. When a button is over a blister, the button can be depressed and a cutting edge pierces the material covering the blister. The carriage is then slid out of the way and the contents of the blister can be removed by pressing a push through tab on the underside of the attachment.

Another embodiment is a bend, twist and pierce system for opening blister packages. Rotatable arms are attached to a blister card via a spike or a barb that also serves as a pivot point. Each rotatable arm has circular pads on the ends with piercing edges underneath. The rotatable arms are initially held in a locked position. The arms, when unlocked, are free to move and can be positioned over a blister compartment. The circular pads are pressed and the material covering the blisters is pierced. The rotatable arms are returned to the locked position and the contents of the blister are removed by conventional means.

Another embodiment is an alternative push-pierce system for opening blister packages. An array of piercing buttons is positioned over a blister card with each button corresponding to a specific blister. The array is attached to the blister card by glue or another appropriate adhesive. Pressing down operates the buttons, piercing the cover material. The button is then lifted and the contents of the blister can be pushed out.

A further variation on the push-pierce system includes an attachment that is attached to a blister card via glue strips or other suitable adhesives.

Another embodiment is a push lock system for opening blister packages. Buttons are arrayed on a cover. Pressing the buttons pierces the cover material and after the button is pulled back a user can push the contents of the blister out. Each button has a locking mechanism. The locking mechanism prevents the button from being pulled up. To unlock the button, a tab must be pushed away from the button while the button is lifted.

Another embodiment is a slide tool system for opening blister packages. A frame is welded to the top of a blister card, but does not cover the center of the blister card. A slideable tool is attached to the underside of the frame and is free to slide up and down the length of the frame. The slideable tool is moved so that a piercing attachment is aligned with a blister compartment. The piercing attachment is pressed into the cover layer and pierces the layer. The slideable tool is then moved and the contents of the blister can then be removed by conventional means.

Another embodiment is a push cutter system for opening blister packaging. An attachment has protrusions that extend from the edges of the frame out over blister compartments. A cutting edge on each protrusion is depressed by the user and pierces a cover layer. The protrusion locks into place, preventing the user from raising the protrusion. Once the user unlocks the protrusion, the user can lift it and access the contents of the blister.

Another embodiment is a tethered tool system for opening blister packaging. A tether tool is folded around an edge of the blister card. The tether tool has an extension made of sufficiently flexible material to allow a cutting device to be positioned over any blister compartments on the blister card. The flexibility of the tethered tool accommodates even unusual blister configurations. The cutting device is pressed into a cover material over a blister. The tethered tool is then removed from the cover layer and locked into a childproof holder on the frame of the tethered tool. The user can then access the contents of the blister package by conventional means.

In another embodiment, the cutting device also contains a locking button mechanism which, when pressed, presents the cutting edge. Upon piercing a blister compartment, the cutting edge is automatically reset within its housing. The button must be pressed and the cutting edge activated prior to each piercing and dose releasing.

These and further and other objects and features of the invention are apparent in the disclosure, which includes the above and ongoing written specification, with the drawings.

DETAILED DESCRIPTION OF THE PREFERRED EMBODIMENTS

Figure 1:
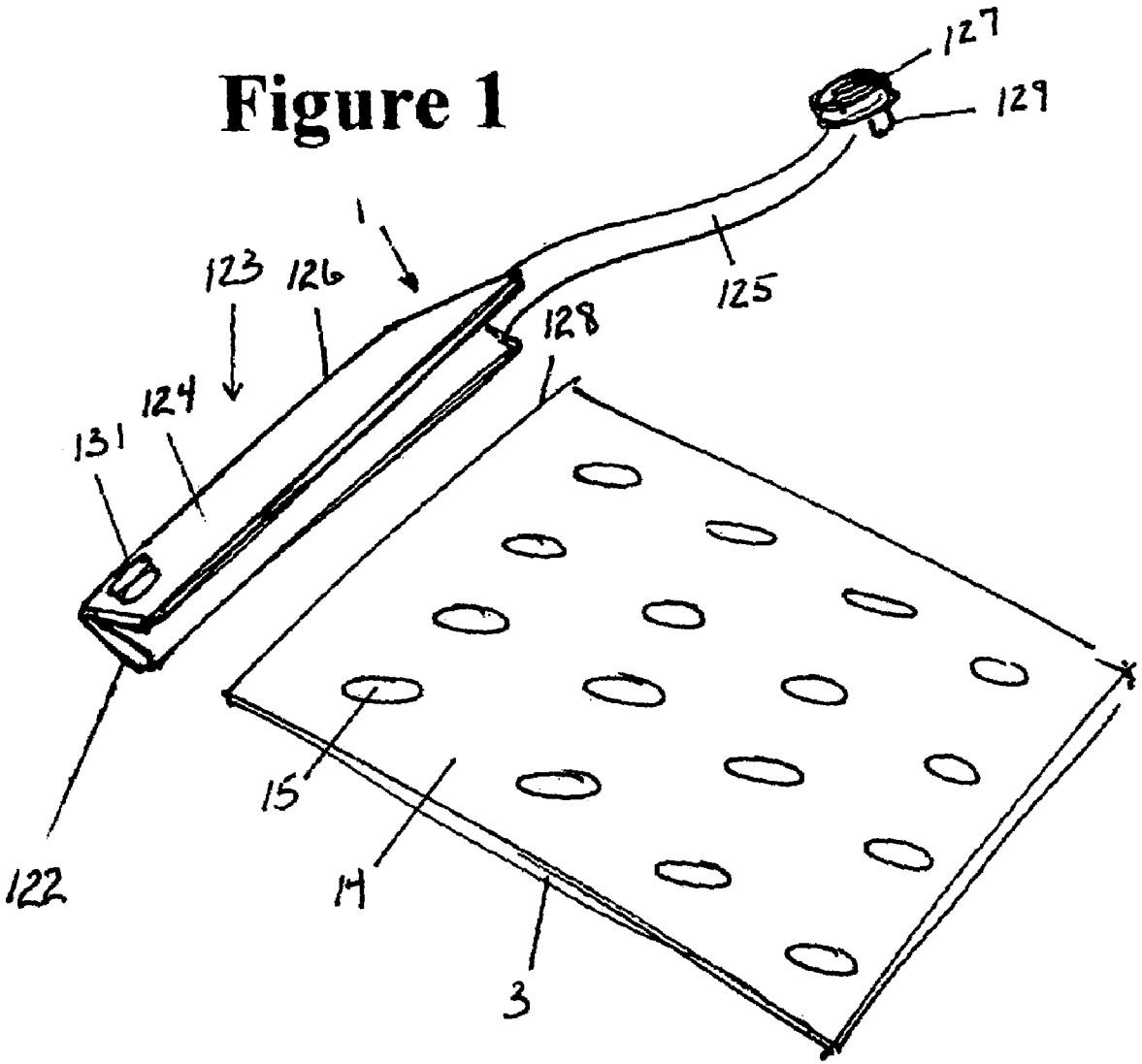
FIG. 1 shows a tethered tool system with the tool unfastened.

The present invention is a method of opening blister type packaging. The present invention facilitates opening of these packages through a variety of methods that elderly or other individuals with inhibited dexterity can easily operate. Additionally, the present invention is childproof. The present invention includes embodiments that offer dual child resistance and the ability to use non-CR foil lid-stock.

Additionally, the ability to provide printed cues and counting devices on the proposed inventions aids in patient compliance. This may include patients more closely adhering to a proper dosage regimen as outlined by drug manufacturer or distributor.

FIGS. 1-5 show a tethered tool system 1 for opening blister packaging. A cover layer 14 covers a blister card 3. A tethered tool frame 123 is folded around an edge of the blister card 3. The tethered tool frame 123 is attached to the blister card 3 by suitable adhesive. The tethered tool 123 has a flexible tether extension 125 made of sufficiently flexible material to allow an opener cutting device 127 to be positioned over any blister position of the cover layer 14 opposite the compartments 15 on the blister card 3. The flexibility of the tethered tool system 1 accommodates many blister 15 configurations, even unusual ones. As shown in FIGS. 1, 2, 4 and 5, the cutting device 127 has a cutting edge 129 that is pushed into the cover material 14, to pierce the material 14. The cutting device 127 is then removed from the cover material 14 and the contents of the blister 15 are removed by conventional means. The cutting device 127 is snapped into a holding socket 131 on frame 123 for storage. While the cutting device 127 is in the holding space 131, it is locked and child resistant. The cutting device 127 must be unlocked before further use.

Figure 5:
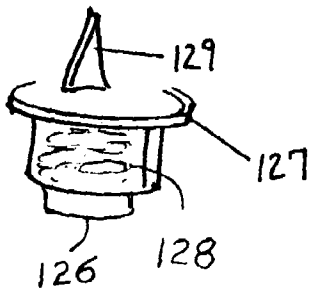
FIG. 5 shows a detail of the tethered tool cutter.

As shown in FIG. 5, a button 126 on holder 127 is pressed to expose a cutter 129. A reset spring 128 within the holder withdraws the blade 129 into the holder 127 after a blister has been cut.

Figure 3:
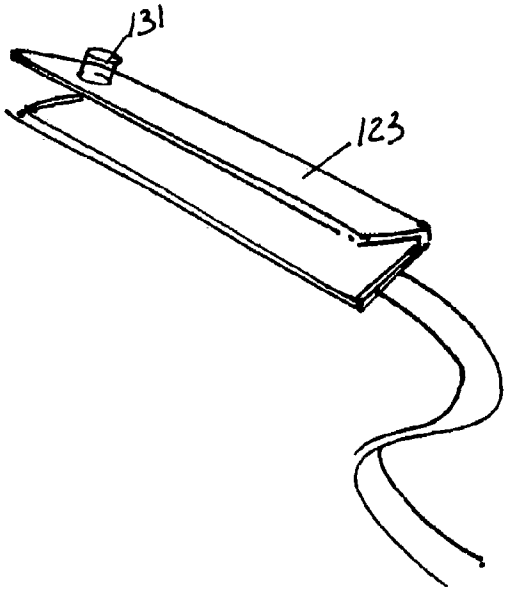
FIG. 3 shows a tethered tool for a tethered tool system.
Figure 2:
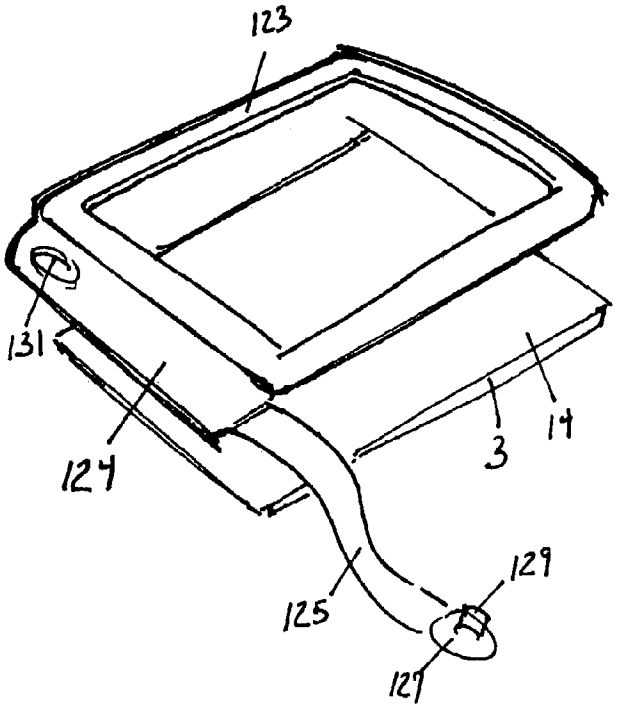
FIG. 2 shows a tethered tool system with the tool aligned with the blister card.
Figure 4:
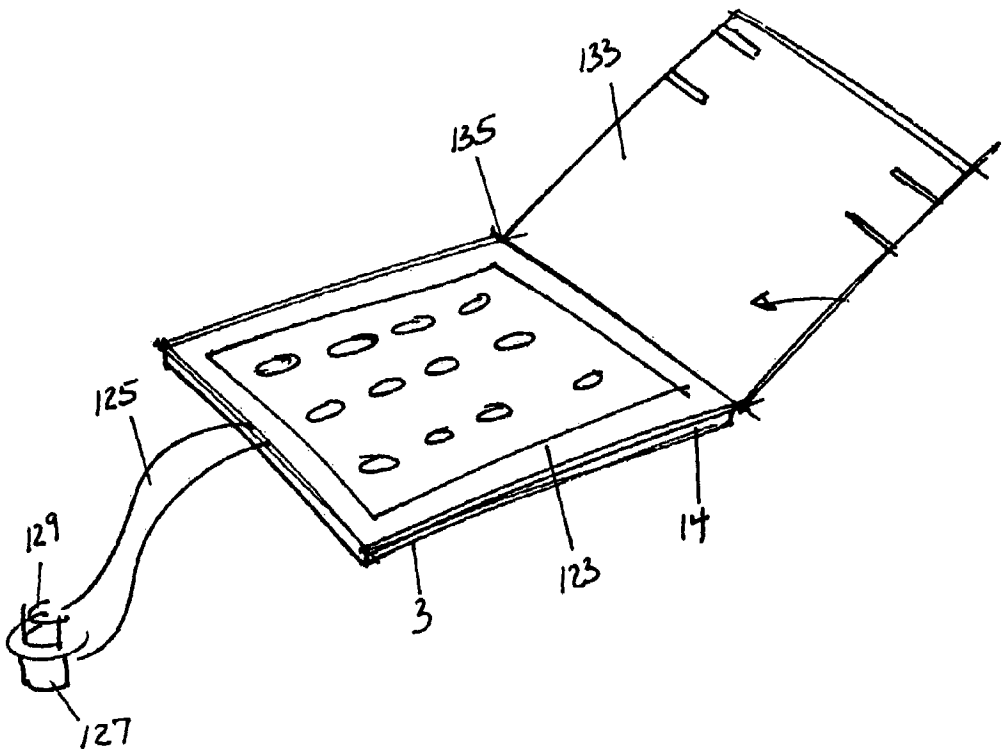
FIG. 4 shows a tethered tool system with child resistant lid.

As shown in FIGS. 1 and 3, frame 123 may have front part 122 and back part 124 hinged 126 together for mounting along one edge 128 of the blister card 3 and backing sheet 14. In FIGS. 2 and 4, the frame 123 covers all edges of the blister card 3 and backing sheet 14. In FIG. 2, the tether 125 and socket 131 are attached to a hinged flap 124.

Alternatively, a book-like cover 133 may be attached to the tethered tool frame 123. The book-like cover 133 is hinged 135 and locks closed in a childproof manner. The socket 131 is mounted outside of the cover 133.

Figure 9:
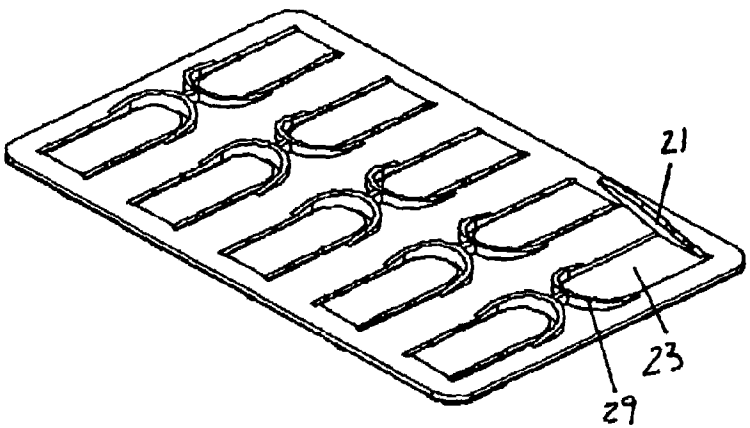
FIGS. 6-9 show a bend and lift system from the top, bottom edge, side edge and the system in operation from the top.
Figure 8:
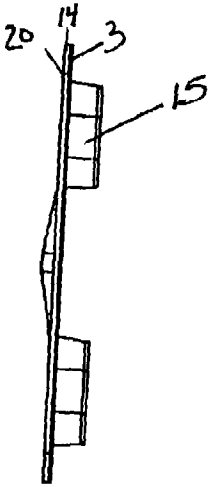
Figure 6:
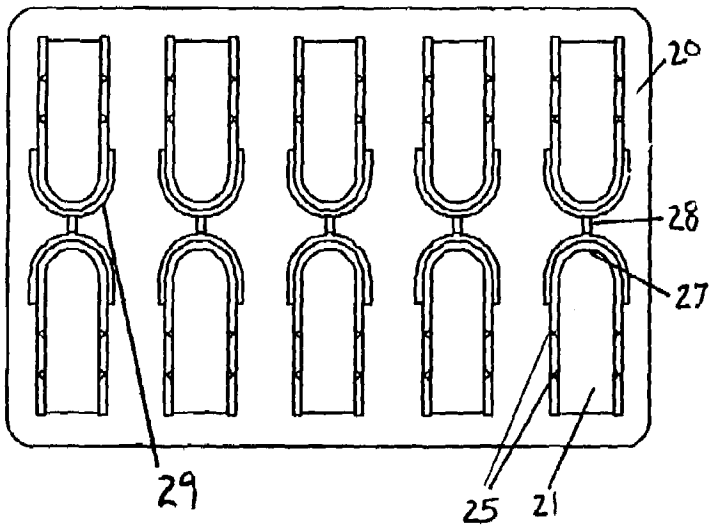
Figure 7:
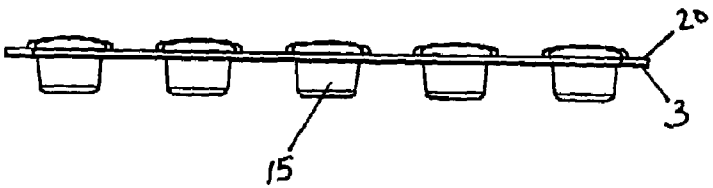
Figure 13:
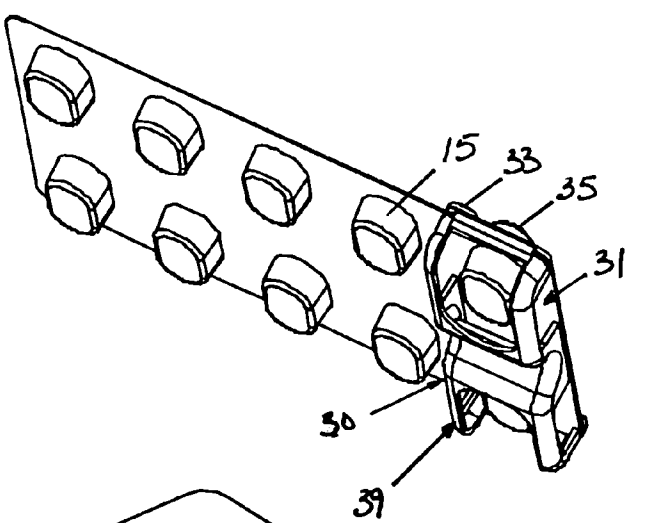
FIGS. 10-13 show a piercing slide attachment system from the top, bottom edge, side edge and bottom.
Figure 14:
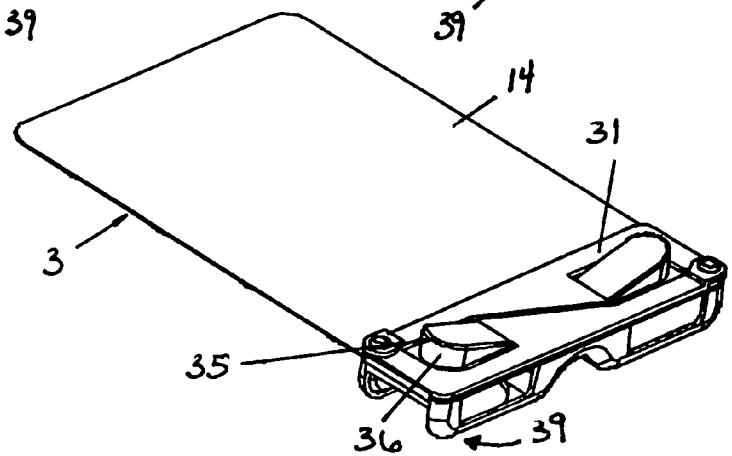
FIG. 14 shows an oblique view of a piercing slide attachment system from the top.
Figure 12:
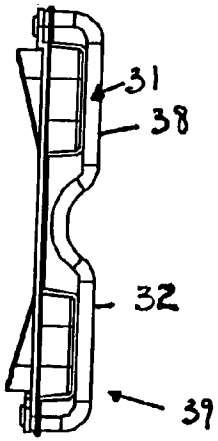
Figure 10:
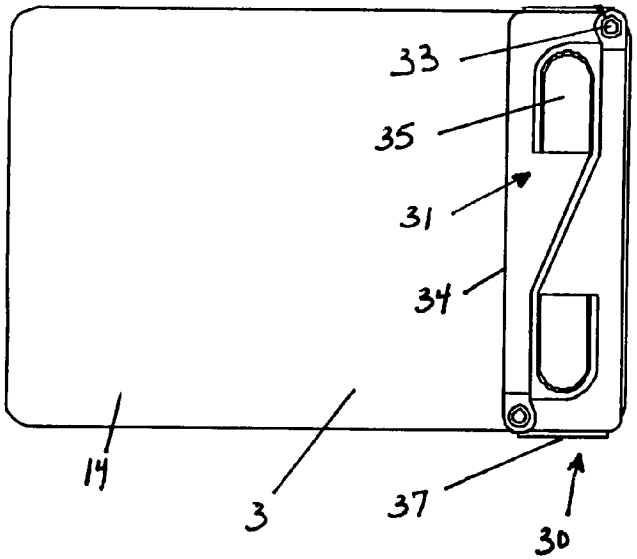
Figure 11:
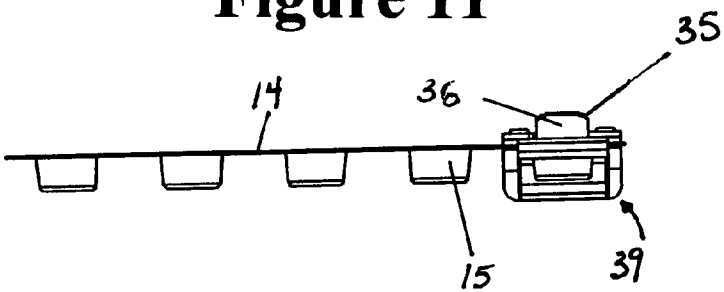
Figure 16:
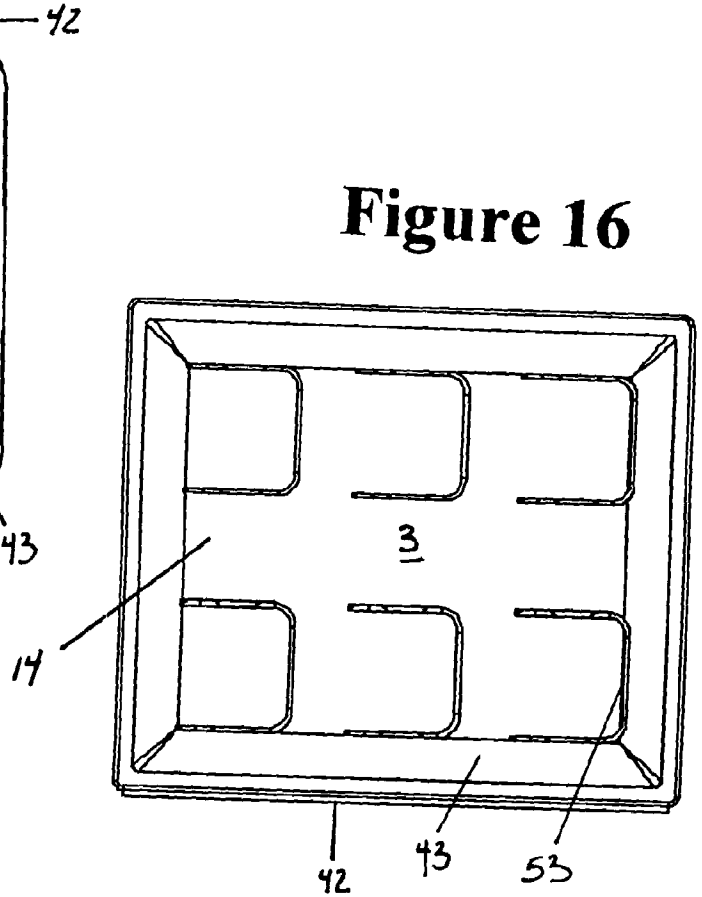
FIGS. 15-20 show a traversing piercing button with blister push-thru tab system from the top, bottom, bottom edge, side edge, bottom and top.
Figure 18:
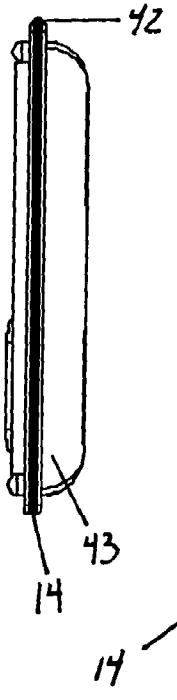
Figure 15:
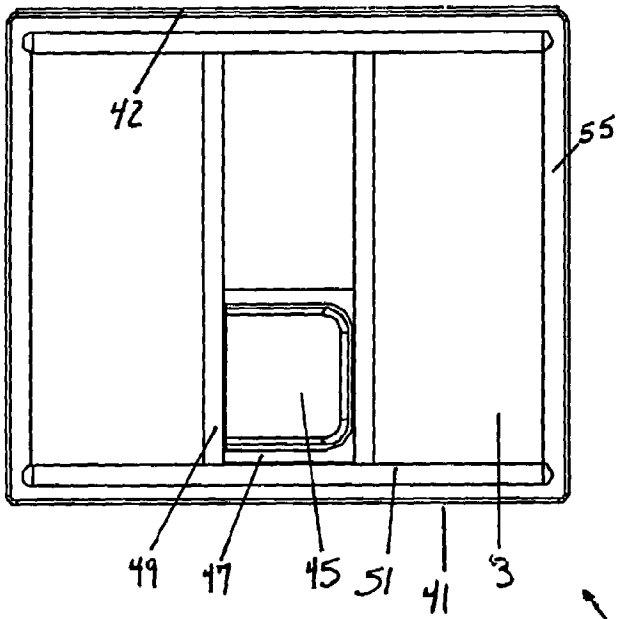
Figure 17:
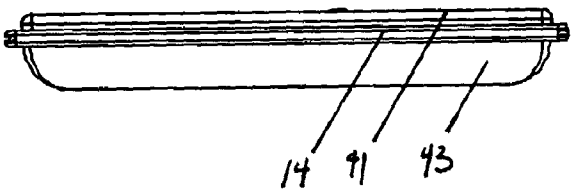
Figure 19:
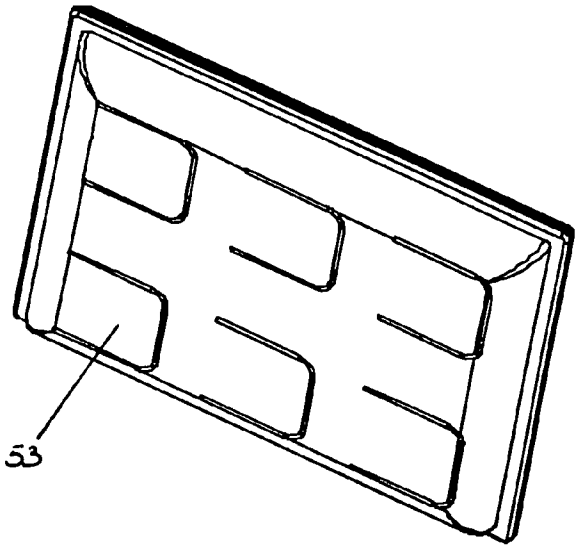
Figure 20:
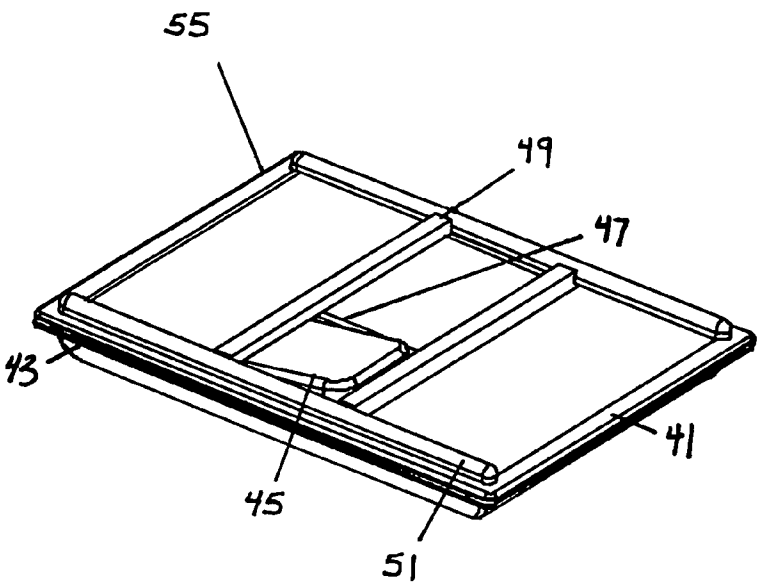
Figure 21:
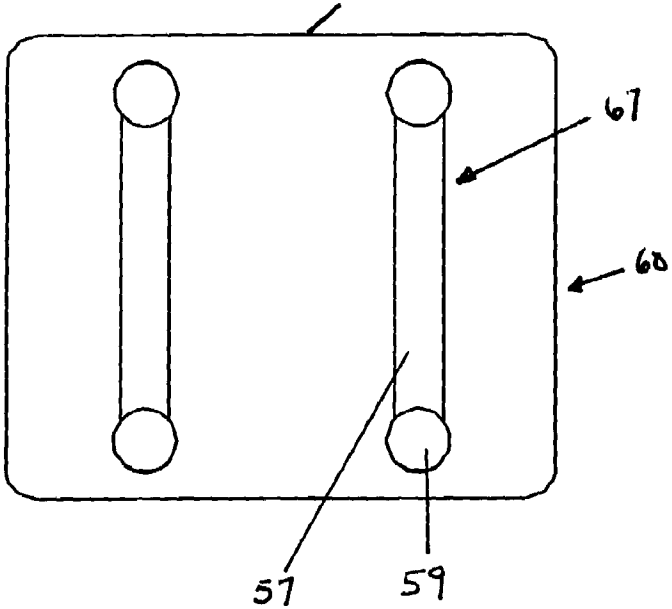
FIGS. 21-26 show a bend, twist and pierce system from the top, bottom, bottom edge, side edge, in operation from the top and from the top.
Figure 24:
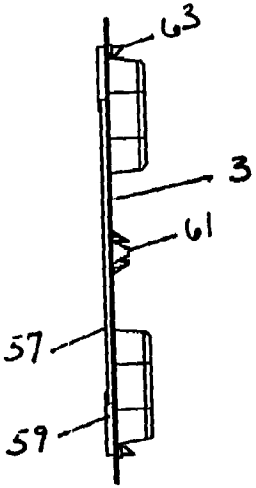
Figure 22:
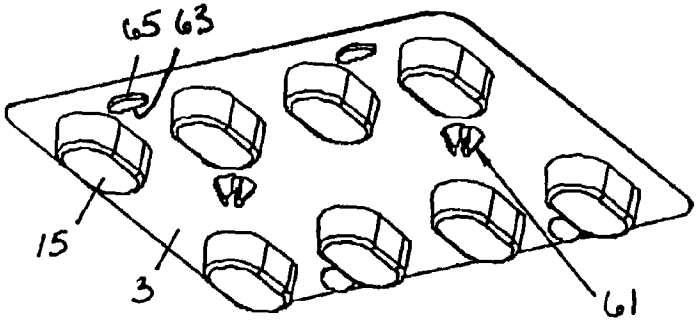
Figure 23:
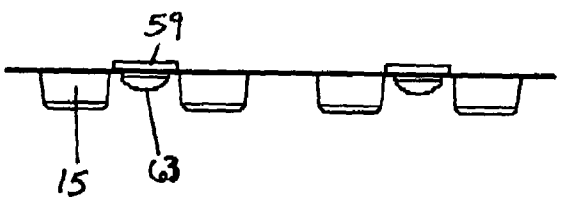
Figure 25:
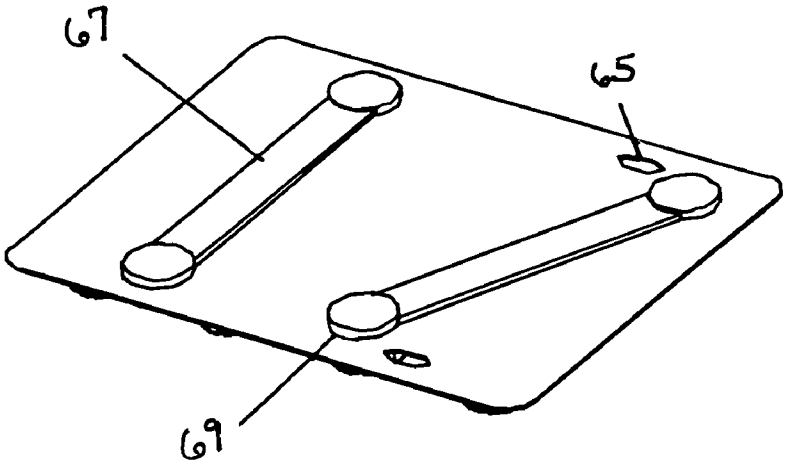
Figure 26:
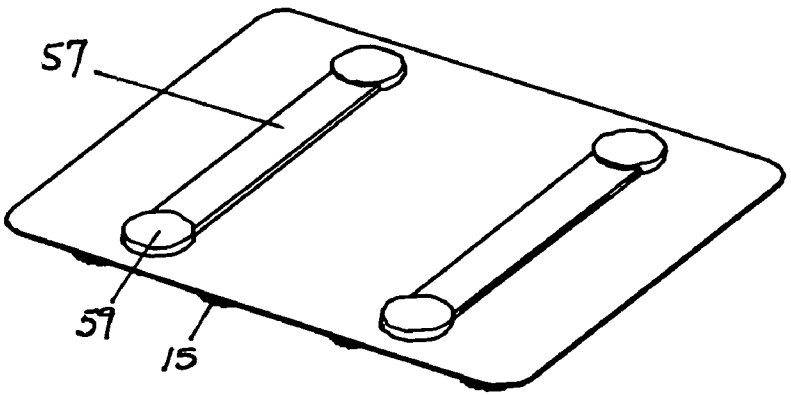
Figure 28:
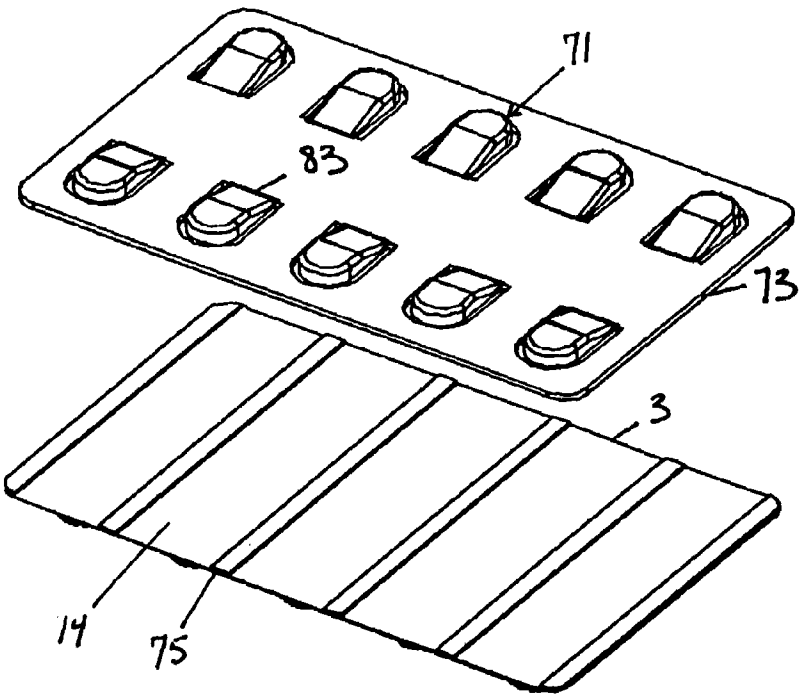
FIG. 28 shows a push-pierce system with a cover and blisters separated and glue strips in place.
Figure 27:
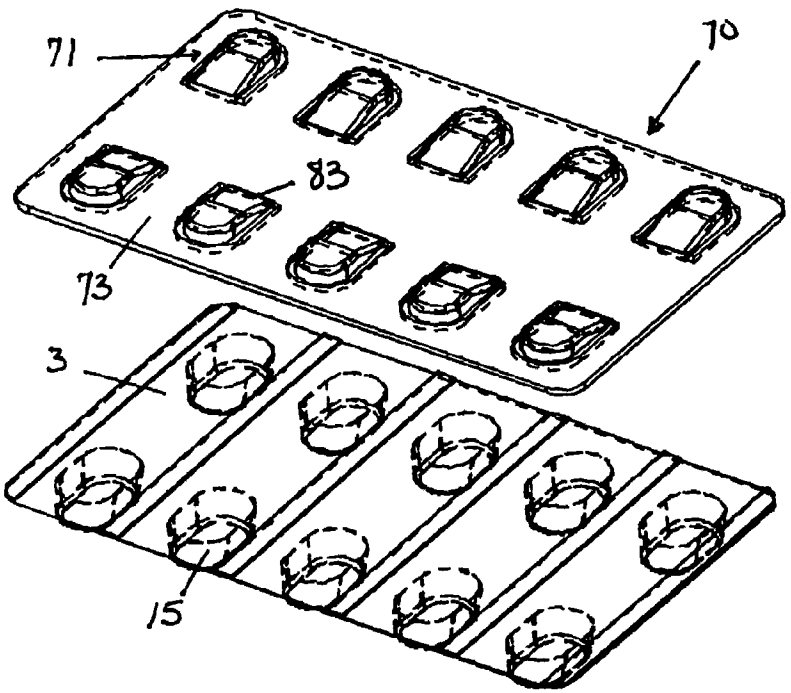
FIG. 27 shows a push-pierce system with a cover and blisters separated.

FIGS. 6-9 depict a bend and lift system for opening blister packages. This embodiment utilizes a plastic tongue 21 that is attached to the periphery of an access hole 23 by breakaway struts 25. Around the lift edge 27 of the tongue 21, there is a vertical wall 29 that the lift edge 27 of tongue 21 must be bent above in order for the user to grab and pull the tongue 21 completely away. The blister card 3 is bent about a longitudinal axis. The blister card 3 is bent so that the lift edge 27 of tongue 21 is raised above the surrounding rims 29. Bridges 28 hold rims 29 in position while a loosened lift edge 27 of tongue 21 pops up during bending. The tongue 21 is lifted as shown in FIG. 9. Once this is done, pushing the pill through a cover layer 14 on the blister tray 3 accesses a pill in a blister 15 of blister tray 3.

FIGS. 10-14 depict a bubble piercing slide attachment system 30 for opening blister packages. A slide 31 with a front 32 and a back 34 folds around a blister card 3 and is held together by snaps or heat-staked posts 33. The slide 31 folds around by means of a living hinge 37. Bridges 38 on front 32 extend over the blisters 15. The attachment slide 31 slides up and down along the card 3. When positioned opposite a blister 15, a button 35 with a cutter 36 hinged on the back 34 can be pressed down, opening or slicing a lid stock 14. Lifting up the button 35 allows the pill to be removed from the blister 15. Alternatively, sliding the unit 31 out of the way and pushing in on the lidstock 14 opposite a blister 15 or pushing on a blister 15 and pushing the tablet through lidstock 14 conventionally allows a user to gain access. A support cradle 39 is formed when the slide 31 is folded around a living hinge 37. This support cradle 39 provides the user with support and something to grip during operation of the buttons 35.

FIGS. 15-20 depict a traversing system 40 with a button 45 for use with push through tabs 53 for opening blister packages. In this embodiment, a top 41 and bottom 43 of a covering wrap around a blister card 3 in a clamshell-like manner. The top 41 and bottom 43 are bent around the blister card 3 through the use of a living hinge 42. The top 41 of the covering wrap is a support for a track frame 55. A carriage 47 is attached to the track frame 55 and allowed to move in the horizontal and vertical directions. A button 45 is attached to the carriage 47. This carriage 47 attaches to vertical slides 49 that lay across the top 41. The vertical slides 49 fit into horizontal slides 51 that are fixed to the top 41. The vertical slides 49 are allowed to move in relation to the horizontal slides 51, and the carriage 47 is allowed to slide relative to the vertical slides 49. In this manner, the button 45 can be positioned over any of the blisters 15 in the container.

To open a blister 15, the button 45 is depressed to pierce a material 14 covering a blister 15. The button 45 and carriage 47 are then moved away from the opened blister 15, and the contents of the blister 15 are pushed out of the blister 15 using a push through tab 53 on the bottom side. A push through tab 53 is located under each individual blister 15.

FIGS. 21-26 depict a bend, twist and pierce system 60 for opening blister packages. This embodiment includes one or more rotatable arms 57. The rotatable arms 57 are snapped onto a blister card 3 via a spike or barb 61. The barb 61 acts as a pivot point for the rotatable arms 57. The rotatable arms 57 have circular pads 59 on each end. The underside of each of the circular pads 59 has a sharp wall 63 that is used to pierce a cover layer 14 over individual blister compartments 15.

The initial position 67 of the rotatable arms 57 is perpendicular to the edges 66 of the blister card 3. In this position 67, the piercing sharp walls 63 fit into locking holes 65. The piercing walls 63 pass through the plane of the blister card 3 and are securely held in the locking holes 65. To operate the bend, twist and pierce system 60, the blister card 3 is bent slightly so that the piercing walls 63 can disengage from the locking holes 65. When the piercing walls 63 are freed from the locking holes 65, the rotatable arms 57 can be rotated into an appropriate piercing position 69, shown in FIG. 25. The rotatable arms 57 are rotated over so that a circular pad 59 is over the desired blister 15, and the circular pad 59 is pressed through the cover layer 14. The rotatable arms 57 are then returned to their locked position 67. The contents of the blister 15 are then removed by conventional means.

FIGS. 27-30 show a push-pierce system 70 for opening blister packages. This embodiment of the present invention includes an array of piercing buttons 71 on a cover 73 over a blister card 3. Each piercing button 71 is situated over a corresponding blister compartment 15. Glue strips or other acceptable adhesive materials 75 are laid out over a cover layer 14 that is attached to the blister card 3. The adhesive materials 75 are arranged so that they do not interfere with the operation of the piercing buttons 71. The piercing buttons carry sharp piercing walls similar to those in systems 60 and 30.

Figure 29:
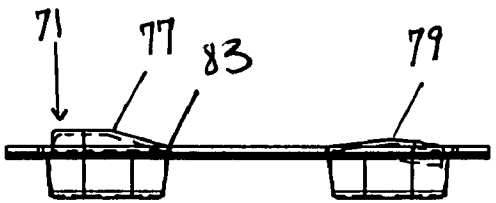
FIG. 29 shows a push-pierce system from the side with one cutter in the relaxed position and another in the cutting position.

FIG. 29 shows the operation of the push-pierce system. A piercing button 71 is depressed from its initial position 77 to a fully depressed position 79.

Figure 30:
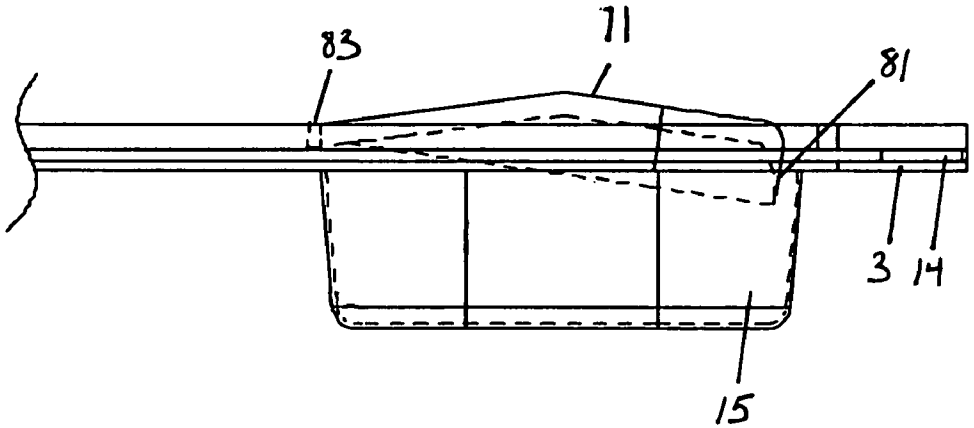
FIG. 30 shows a magnification of the push-pierce cutter in the depressed position.

FIG. 30 is a magnified view of the piercing button 71 in the fully depressed position. When the button 71 is pressed, the cover material 14 is pierced in an approximately 180-degree arc around a sharp leading edge 81 of the button 71, at the opposite end of a hinge 83. The piercing button 71 is then lifted and the contents of a blister 15 are removed by conventional means.

Figure 32:
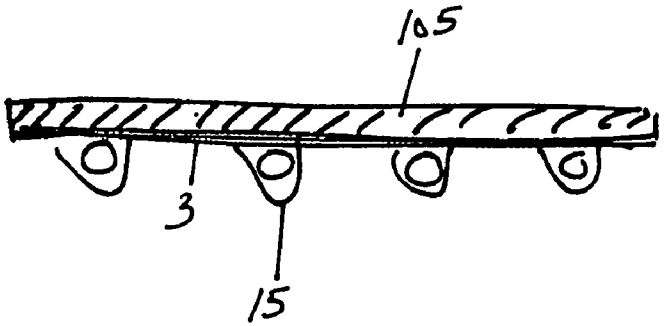
FIG. 32 shows a sliding tool system from the side.
Figure 31:
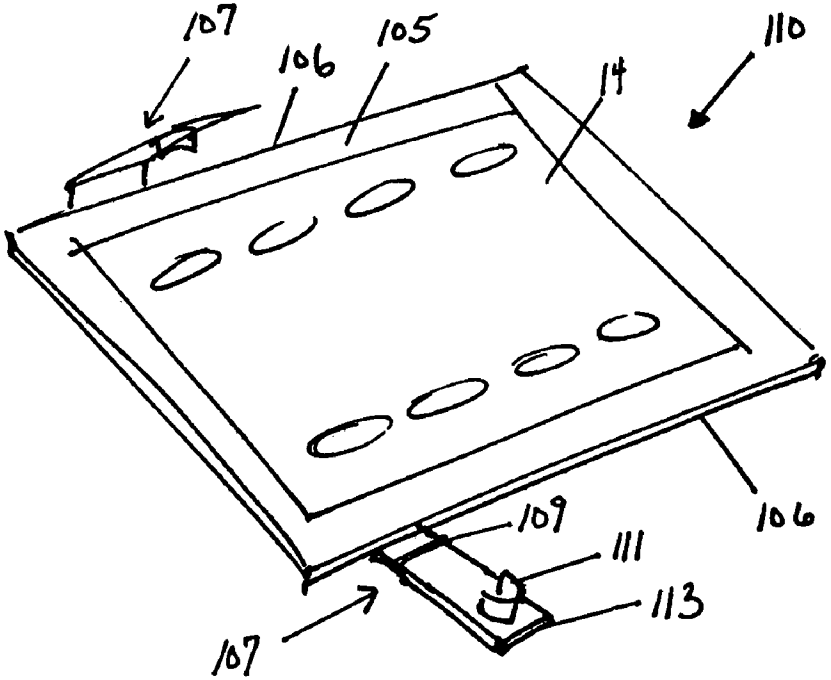
FIG. 31 shows a sliding tool system with a frame attached to a blister card.

FIGS. 31 and 32 show a slide tool system 110 for opening blister packages. A frame 105 is welded or bonded to the top of a blister card 3. The frame 105 covers the edges of the blister card 3 but does not cover the center of the blister card 3. A cover layer 14 remains exposed. A slideable tool 107 is attached on each of two opposite sides 106 of the frame 105. The slideable tool 107 is attached to the underside of the frame 105 and is free to slide up and down along the length of the frame 105. The tool 107 is hinged 109 to allow it to wrap around to the top of the frame 105. A piercing attachment 111 is located on a section 113 of the tool 107 that comes in contact with the cover layer 14. The slideable tool 107 is moved so that when the tool 107 is folded, the piercing attachment 111 is aligned with a blister compartment 15. The tool 107 is pressed into the cover layer 14 and pierces the layer 14. The slideable tool 107 is then moved, and the contents of the blister 15 can then be removed by conventional means.

Figure 35:
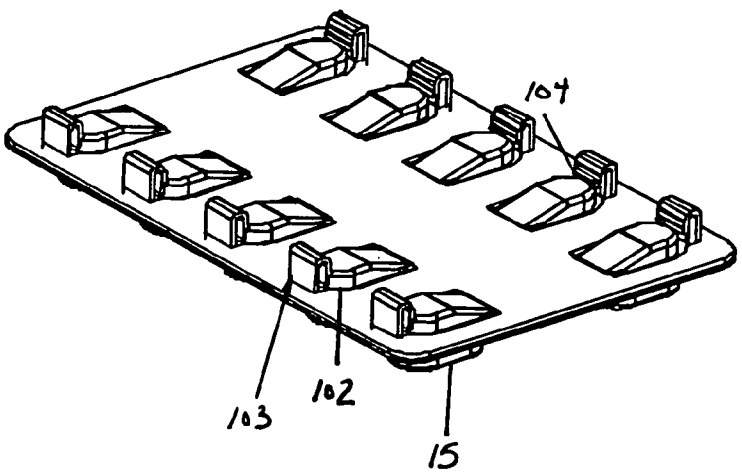
FIGS. 33-35 show a push lock system from the top, side edge and top.
Figure 34:
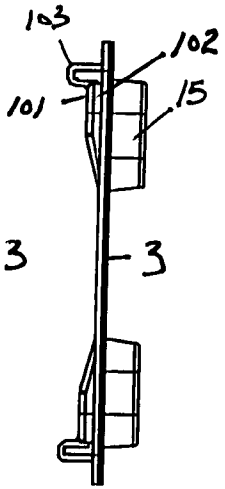
Figure 33:
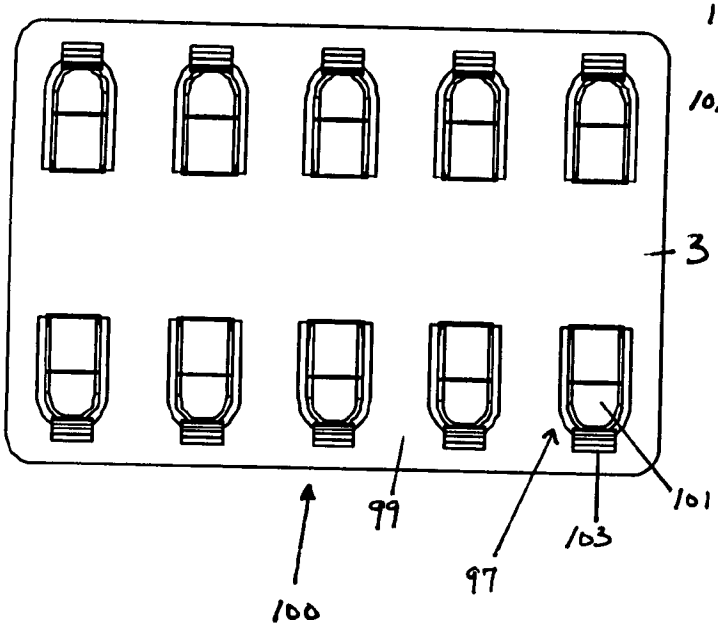

FIGS. 33-35 show a push lock system 100 for opening blister packages. Buttons 97 are arrayed on a cover 99. As in previous embodiments, the buttons 97 have cutting walls 102 that break though a cover layer 14 when depressed. A latching means 103 is employed so that the button 97 cannot be pulled up until the latch 103 is disengaged. The latching means 103 has a tab 104 that extends over the button 97. The tab 104 must be pushed backward and outward for the user to lift the end 101 of a button 97 and rotate the button around hinge 98 to access a blister 15. That prevents accidental release of the contents of the blister compartments 15.

Figure 36:
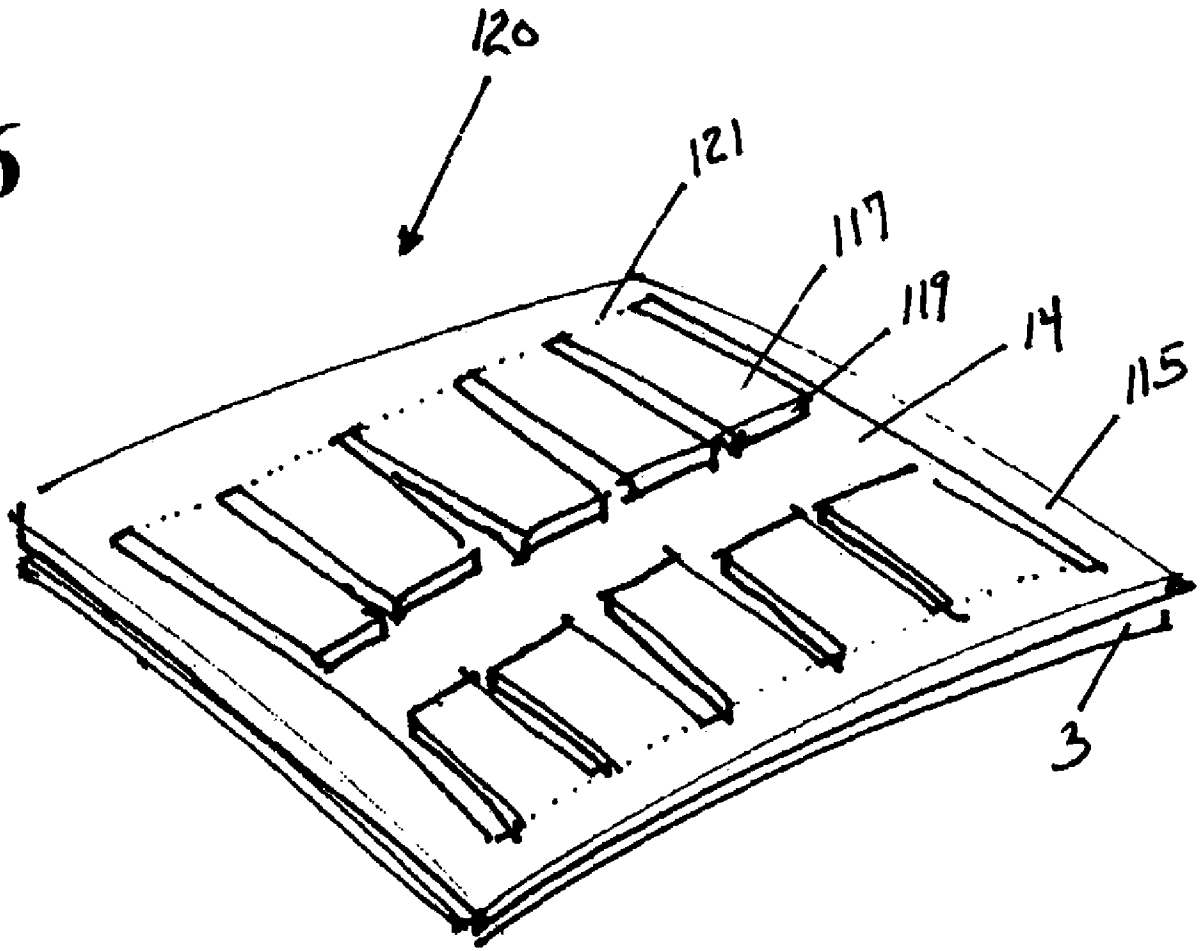
FIG. 36 shows a push cutter system.

FIG. 36 shows a push cutter system 120 for opening blister packaging. A frame 115 is welded or bonded to a blister card 3. A cover layer 14 is sandwiched between the frame 115 and the blister card 3. The frame 115 has protrusions 117 that extend from the edges of the frame 115 out over blister compartments 15. Each protrusion 117 has a cutting edge 119 that is depressed by the user. A protrusion 117 with a cutting edge 119 rotates around a hinge 121 and pierces the cover layer 14. Each protrusion has two stable positions, an outward inoperative position and an inward position, in which the blister-covering layer 14 has been pierced. The protrusion 117 is then lifted backwards in an unlocking stage along the hinge 121, and the contents of a blister 15 can be removed by conventional means. The unlocking stage is a child resistant stage as the protrusion 117 locks in place after being depressed.

While the invention has been described with reference to specific embodiments, modifications and variations of the invention may be constructed without departing from the scope of the invention.

The invention claimed is:

1. Blister package opener apparatus comprising:

a blister package having blisters and a cover layer, a frame connected to a top of the blister package, and an opener connected to the frame, wherein the frame covers the cover layer, the opener comprises lifting tabs having ends hinged to the frame, and the outer ends of the tabs are hinged to the frame, and further comprising raised guards surrounding inner ends of the tabs and bridges connecting the raised guards for raising inner ends of the tabs above the guards only when the blister package is bent, for grasping inner ends of the tabs and lifting the tabs around the hinges for providing access to the cover layer opposite a selected blister.

2. Blister package opener apparatus comprising:

a blister package having blisters and a cover layer, a frame connected to a top of the blister package, and an opener connected to the frame, wherein the frame covers the cover layer, the opener comprises comprise lifting tabs having ends hinged to the frame, and the tabs have side edges, and further comprising frangible connectors connecting the side edges to the frame until the inner ends of the tabs are lifted.

3. Blister package opener method comprising:

providing a blister package having blisters and a cover layer, providing a frame connected to sides of the blister package, providing an opener connected to the frame, and covering the cover layer with the frame, wherein the opener comprises lifting tabs having ends hinged to the frame and the outer ends of the tabs are hinged to the frame, and wherein raised guards surround inner ends of the tabs and bridges connect the raised guards for raising inner ends of the tabs above the guards when the blister package is bent for grasping inner ends of the tabs and lifting the tabs around the hinges for providing access to the cover layer opposite a selected blister.

4. Blister package opener method comprising:

providing a blister package having blisters and a cover layer, providing a frame connected to sides of the blister package, providing an opener connected to the frame, and covering the cover layer with the frame, wherein the opener comprises lifting tabs having ends hinged to the frame and the tabs have side edges and wherein fractible connectors connect the side edges to the frame until the inner ends of the tabs are lifted.

5. Blister package opener method comprising:

providing a blister package having blisters and a cover layer, providing a frame connected to sides of the blister package, and providing an opener connected to the frame, wherein the opener comprises tabs printed with days or numbers arranged with frangible connectors for providing visual destruction confirmation that a particular tab has been opened, thus aiding in patient compliance and dose regimen tracking.

* * * * *